US006755173B1

(12) United States Patent
Yoshida et al.

(10) Patent No.: US 6,755,173 B1
(45) Date of Patent: Jun. 29, 2004

(54) VERTICAL ENGINE

(75) Inventors: Hiroyuki Yoshida, Wako (JP); Hiroki Tawa, Wako (JP); Tamotsu Momosaki, Wako (JP); Hideaki Takada, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 55 days.

(21) Appl. No.: 10/088,081

(22) PCT Filed: Sep. 22, 2000

(86) PCT No.: PCT/JP00/06529

§ 371 (c)(1),
(2), (4) Date: Mar. 21, 2002

(87) PCT Pub. No.: WO01/21940

PCT Pub. Date: Mar. 29, 2001

(30) Foreign Application Priority Data

Sep. 24, 1999 (JP) ..... 11-270876
Sep. 24, 1999 (JP) ..... 11-270877

(51) Int. Cl.[7] ..... F01M 11/00
(52) U.S. Cl. ..... 123/196 W
(58) Field of Search ..... 123/196 W, 196 R, 123/195 P, 198 C; 184/6.28, 27.1, 6.5, 104.3; 440/88, 89, 900

(56) References Cited

U.S. PATENT DOCUMENTS 5,118,316 A * 6/1992 Kakizaki et al. ..... 440/89 R
5,683,277 A * 11/1997 Tsunoda et al. ..... 440/88 R
5,934,957 A * 8/1999 Sato et al. ..... 440/88 L
6,367,442 B1 * 4/2002 Takayanagi ..... 123/196 W
6,502,666 B2 * 1/2003 Takada et al. ..... 184/6.28

FOREIGN PATENT DOCUMENTS

| | | |
|---|---|---|
| JP | 6-25415 | 2/1989 |
| JP | 4-362231 | 12/1992 |
| JP | 6-033725 | 2/1994 |
| JP | 8-100707 | 4/1996 |
| JP | 10-121932 | 5/1998 |
| JP | 10-213010 | 8/1998 |

* cited by examiner

*Primary Examiner*—Tony M. Argenbright
*Assistant Examiner*—Hyder Ali
(74) *Attorney, Agent, or Firm*—Arent Fox PLLC

(57) ABSTRACT

An oil pan-coupled surface $\mathbf{11}_5$ formed on a lower surface of an engine block 11 having a crankshaft 15 supported to be directed vertically is extended below a cylinder head 12 beyond a line L extending downwards from a cylinder head-coupled surface $\mathbf{11}_4$ formed on a rear surface of the engine block 11. Thus, it is possible to increase the area of the oil pan-coupled surface $\mathbf{11}_5$ without interference with the cylinder head-coupled surface $\mathbf{11}_4$ and to increase the volume of an oil pan $\mathbf{41}_1$ coupled to the oil pan-coupled surface $\mathbf{11}_5$. Moreover, the cylinder head-coupled surface $\mathbf{11}_4$ and the oil pan-coupled surface $\mathbf{11}_5$ are not continuous with each other and hence, there is no possibility that the sealing of the coupled surfaces $\mathbf{11}_4$ and $\mathbf{11}_5$ may be impeded.

5 Claims, 14 Drawing Sheets

72
11
11
11

VERTICAL ENGINE

FIELD OF THE INVENTION

The present invention relates to a vertical engine including a crankshaft supported to be directed vertically.

BACKGROUND ART

In general, in a vertical engine including a crankshaft supported to be directed vertically in an engine block, a cylinder head-coupled surface for coupling a cylinder head and an oil pan-coupled surface for coupling an oil pan are formed on the engine block. Japanese Utility Model Application Laid-open No.64-25415 describes a vertical engine in which an end edge of an oil pan-coupled surface is positioned at a location short of a line extending downwards from a cylinder head-coupled surface, and Japanese Patent Application Laid-open No.8-100707 describes a vertical engine in which an oil pan-coupled surface is formed over a lower surface of an engine block and a lower surface of a cylinder head.

It should be noted here that the vertical engine described in the above Japanese Utility Model Application Laid-open No.64-25415 suffers from a problem that the area of the oil pan-coupled surface is insufficient, resulting in a limited volume of the oil pan, because the end edge of the oil pan-coupled surface is positioned at the location short of the line extending downwards from the cylinder head-coupled surface. The vertical engine described in the above Japanese Patent Application Laid-open No.8-100707 suffers from a problem that because the oil pan-coupled surface is formed over the lower surface of the engine block and the lower surface of the cylinder head, a flat coupled surface must be formed by a common machining, including a gasket between the engine block and the cylinder head, thereby causing an increase in machining cost. Moreover, special machining equipment capable of machining the hard gasket is required.

In a vertical engine in which an exhaust gas passage, a cooling-water passage, a drainage passage and the like extending vertically are provided in an oil pan forming member having an oil pan integrally provided therein, openings in the passages and an opening in the oil pan interfere with each other and for this reason, not only the position of the opening in the oil pan but also the volume of the oil pan is limited. Especially, in a vertical engine in which cooling-water passages are defined on opposite sides of a cylinder bore, it is necessary to provide a water-dispensing portion in the oil pan forming member for dispensing cooling water to each of the cooling-water passages on the opposite sides of the cylinder bore, and the position of the opening in the oil pan and the volume of the oil pan are further limited by the water-dispensing portion.

In general, an engine block forming a body of an engine is divided into two components: a cylinder block and a crankcase at a parting plane including the axis of a crankshaft, and the crankshaft is supported so as to be sandwiched between the cylinder block and the crankcase.

A single-cylinder vertical engine described in Japanese Patent Application Laid-open No.4-362231 is comprised of an engine block including an engine body integrally provided with a cylinder bore and a crankcase, and an upper cover which closes an opening in an upper surface of the engine block. A lower journal of the crankshaft is supported in a bearing bore provided in the engine block, and an upper journal of the crankshaft is supported in a bearing bore provided in the upper cover.

It should be noted here that if the engine block is divided into the cylinder block and the crankcase at the parting plane including the axis of the crankshaft, the bearing bores supporting the journals of the crankshaft are defined astride the cylinder block and the crankcase and hence, it is necessary to make the bearing bores by a common machining in a state in which the cylinder block and the crankcase have been temporarily coupled to each other. For this reason, the following problem is encountered: Steps of coupling and separating the cylinder block and the crankcase to and from each other are required, resulting in an increase in machining cost, and moreover, the cylinder block and the crankcase which were made by the common machining must be used in a set, resulting in a poor interchangeability of the components.

In the single-cylinder vertical engine described in Japanese Patent Application Laid-open No.4-362231, the oil supplied from an oil pump mounted in the cylinder block to the bearing bore of the lower journal of the crankshaft is supplied through an oil passage defined in the crankshaft to a crankpin portion supporting a connecting rod and then through an oil passage defined in the crankshaft to the bearing bore of the upper journal. Therefore, especially in the case of a multi-cylinder engine, the following problem is encountered: the structure of the oil passage in the crankshaft is complicated, and moreover, it is difficult to supply a sufficient amount of oil to the bearing bore of the upper journal of the crankshaft.

DISCLOSURE OF THE INVENTION

The present invention has been accomplished with the above circumstances in view, and it is a first object of the present invention to increase the volume of an oil pan coupled to an oil pan-coupled surface formed on a lower surface of an engine block by a simple structure in a vertical engine including a crankshaft supported to be directed vertically.

It is a second object of the present invention to enhance the workability and lubricatability of the bearing bores of journals of the crankshaft in the vertical engine.

To achieve the above first object, according to the present invention, there is provided a vertical engine comprising an engine block including a cylinder bore integrally provided therein and a crankshaft supported to be directed vertically, a cylinder head coupled to a cylinder head-coupled surface vertically formed on the engine block, and an oil pan coupled to an oil pan-coupled surface horizontally formed on the engine block, wherein the oil pan-coupled surface extends below the cylinder head beyond a line extending downwards from the cylinder head-coupled surface.

With the above arrangement, the oil pan-coupled surface formed on the engine block extends below the cylinder head beyond the line extending downwards from the cylinder head-coupled surface. Therefore, the area of the oil pan-coupled surface can be increased without interference with the cylinder head-coupled surface, and the volume of the oil pan coupled to the oil pan-coupled surface can be increased. Moreover, the cylinder head-coupled surface and the oil pan-coupled surface are not continuous with each other and hence, there is no possibility that the sealing of the coupled surfaces may be impeded.

An oil case-coupled surface $\mathbf{11}_5$ in each of the embodiments corresponds to the oil pan-coupled surface of the present invention.

To achieve the above first object, in addition to the above arrangement, there is a provided a vertical engine including the above-described arrangement, wherein an oil pan forming member having the oil pan integrally provided therein is integrally formed with a peripheral wall of a main exhaust passage.

With the above arrangement, the peripheral walls of the main exhaust passages are integrally formed on the oil pan forming member. Therefore, the main exhaust passages can be displaced toward the cylinder head without recourse to mating surfaces of the engine block and the cylinder head. As a result, the area of an opening in the oil pan can be increased, leading to an increased volume of the oil pan.

To achieve the above first object, in addition to the above arrangement, there is provided a vertical engine wherein the oil pan forming member is integrally formed with a peripheral wall of a cooling-water passage.

With the above arrangement, the peripheral walls of the cooling-water passages are integrally formed on the oil pan forming member. Therefore, the cooling-water passages can be displaced toward the cylinder head without recourse to mating surfaces of the engine block and the cylinder head. As a result, the area of an opening in the oil pan can be increased, leading to an increased volume of the oil pan.

To achieve the above second object, according to the present invention, there is provided a vertical engine having a crankshaft supported to be directed vertically, comprising an engine block which is formed by molding integrally with a cylinder bore and a crankcase and which has a bearing bore defined therein for supporting a lower journal of the crankshaft, an upper cover which is coupled to the engine block so as to close an opening in an upper surface of the engine block and which has a bearing bore defined therein for supporting an upper journal of the crankshaft, an oil pan coupled to a lower surface of the engine block, an oil pump for supplying an oil within the oil pan to portions to be lubricated, and an oil passage which is defined in the engine block and the upper cover and through which the oil discharged from the oil pump is supplied to the bearing bore for supporting the upper journal of the crankshaft.

With the above arrangement, the bearing bore for supporting the lower journal of the crankshaft is defined only in the engine block, and the bearing bore for supporting the upper journal of the crankshaft is defined only in the upper cover. Therefore, to make both of the bearing bores, it is not required that a common machining is conducted in a state in which two members have been coupled to each other. Thus, steps of coupling and separating the two members to and from each other are not required, leading to a reduction in machining cost, and also the engine block and the upper cover can be exchanged independently, leading to an enhanced interchangeability. Moreover, the supplying of the oil to the bearing bore of the upper journal of the crankshaft is conducted from the oil pump through the oil passages defined in the engine block and the upper cover. Therefore, the supplying of the oil is reliably achieved, and the structures of the oil passages are also simplified, as compared with a system in which the supplying of the oil to the bearing bore of the upper journal is conducted through an oil passage defined in the crankshaft.

To achieve the second object, in addition to the above arrangement, there is a provided a vertical engine wherein a most downstream portion of the oil passage defined in the upper cover comprises a blind bore provided at a location spaced obliquely and upwards apart from an inner peripheral surface of the bearing bore in the upper cover.

With the above arrangement, the most downstream portion of the oil passage in the upper cover comprises a blind bore provided at the location spaced obliquely and upwards apart from the inner peripheral surface of the bearing bore in the upper cover. Therefore, the blind bore can easily be made from the side of the lower surface of the upper cover, and moreover, it is unnecessary to provide a blind plug required when the most downstream oil passage is comprised of a through-bore extending from the outer surface of the upper cover to the inner peripheral surface of the bearing bore. This contributes to reductions in number of components and number of machining steps.

BRIEF DESCRIPTION OF THE DRAWINGS

FIGS. 1 to 12 show a first embodiment of the present invention, wherein FIG. 1 is a side view of an entire outboard engine system;

FIG. 2 is an enlarged sectional view of an essential portion shown in FIG. 1;

FIG. 3 is a sectional view taken along a line 3—3 in FIG. 2;

FIG. 4 is an enlarged view of an essential portion shown in FIG. 2;

FIG. 5 is a view taken along a line 5—5 in FIG. 4;

FIG. 6 is a view taken in the direction of an arrow 6 in FIG. 5;

FIG. 7 is a view taken in the direction of an arrow 7 in FIG. 6;

FIG. 8 is a sectional view taken along a line 8—8 in FIG. 4;

FIG. 9 is a view taken in the direction of an arrow 9 in FIG. 4;

FIG. 10 is a view taken along a line 10—10 in FIG. 4;

FIG. 11 is a sectional view taken along a line 11—11 in FIG. 10;

FIG. 12 is a view taken along a line 12—12 in FIG. 11.

FIGS. 13 and 14 show a second embodiment of the present invention, wherein FIG. 13 is a rear view of an engine block and an oil case; and FIG. 14 is an enlarged sectional view taken along a line 14—14 in FIG. 13.

BEST MODE FOR CARRYING OUT THE INVENTION

A first embodiment of the present invention will be described with reference to FIGS. 1 to 12.

Figure 1:
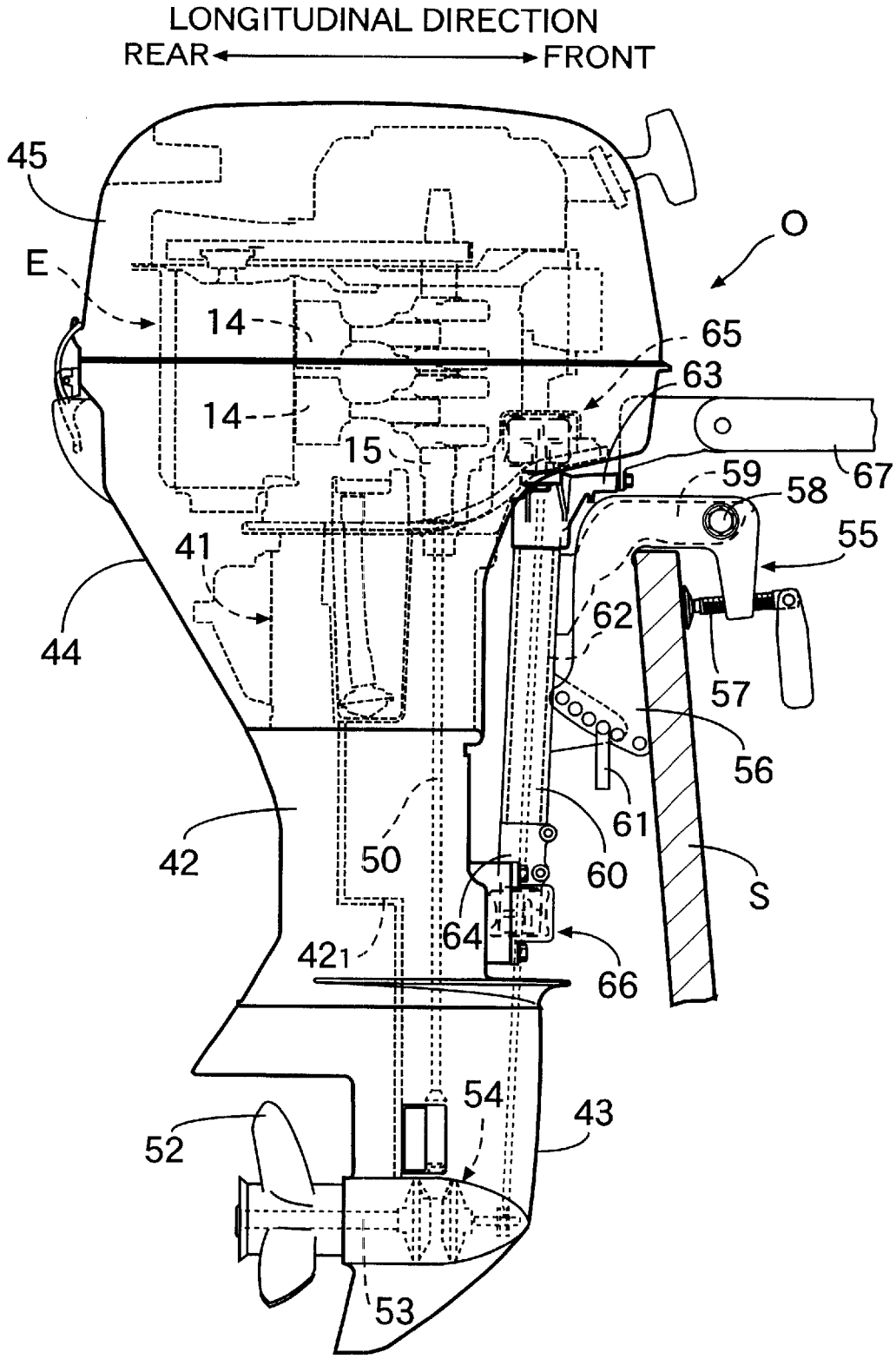
Figure 2:
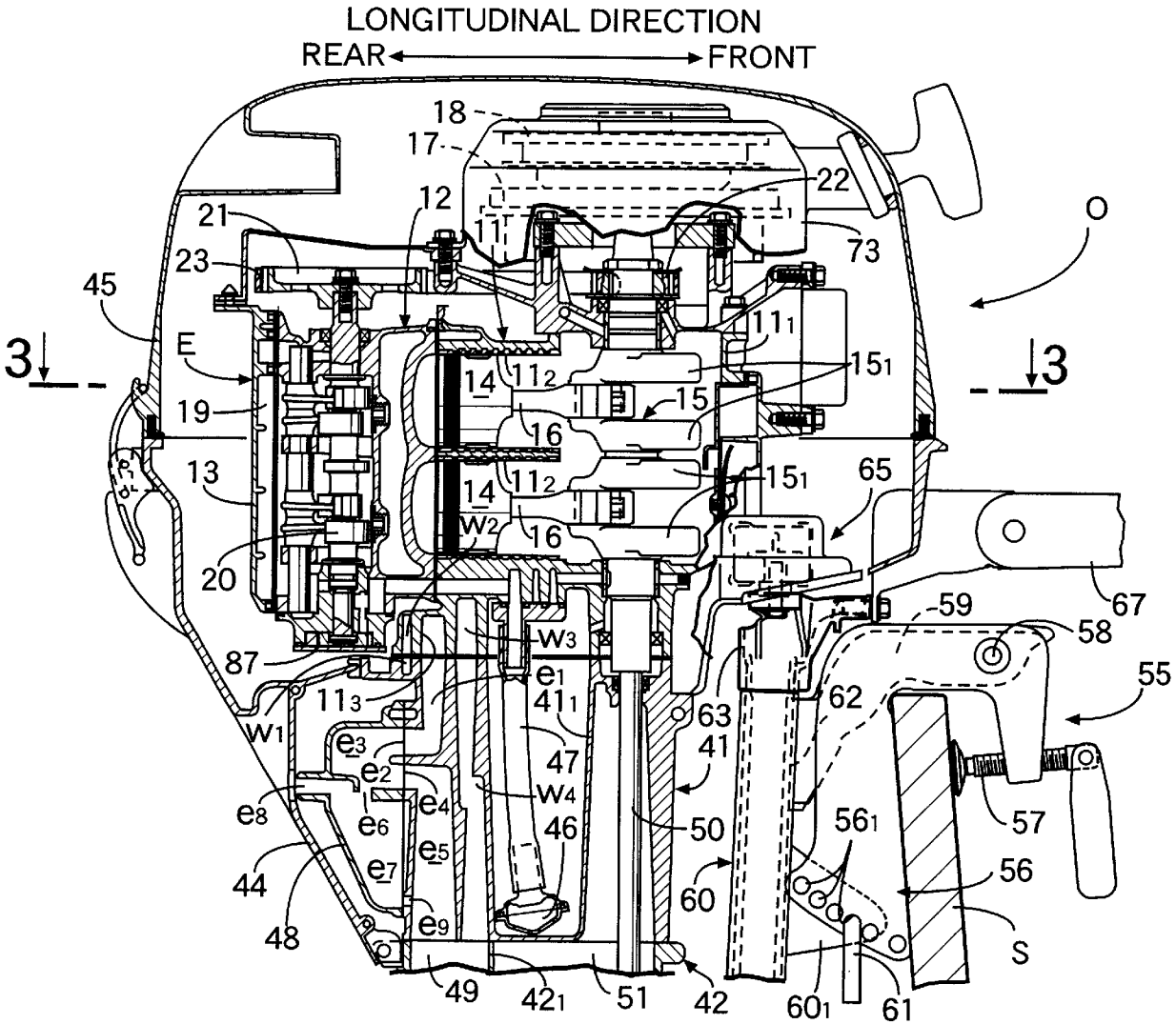
Figure 3:
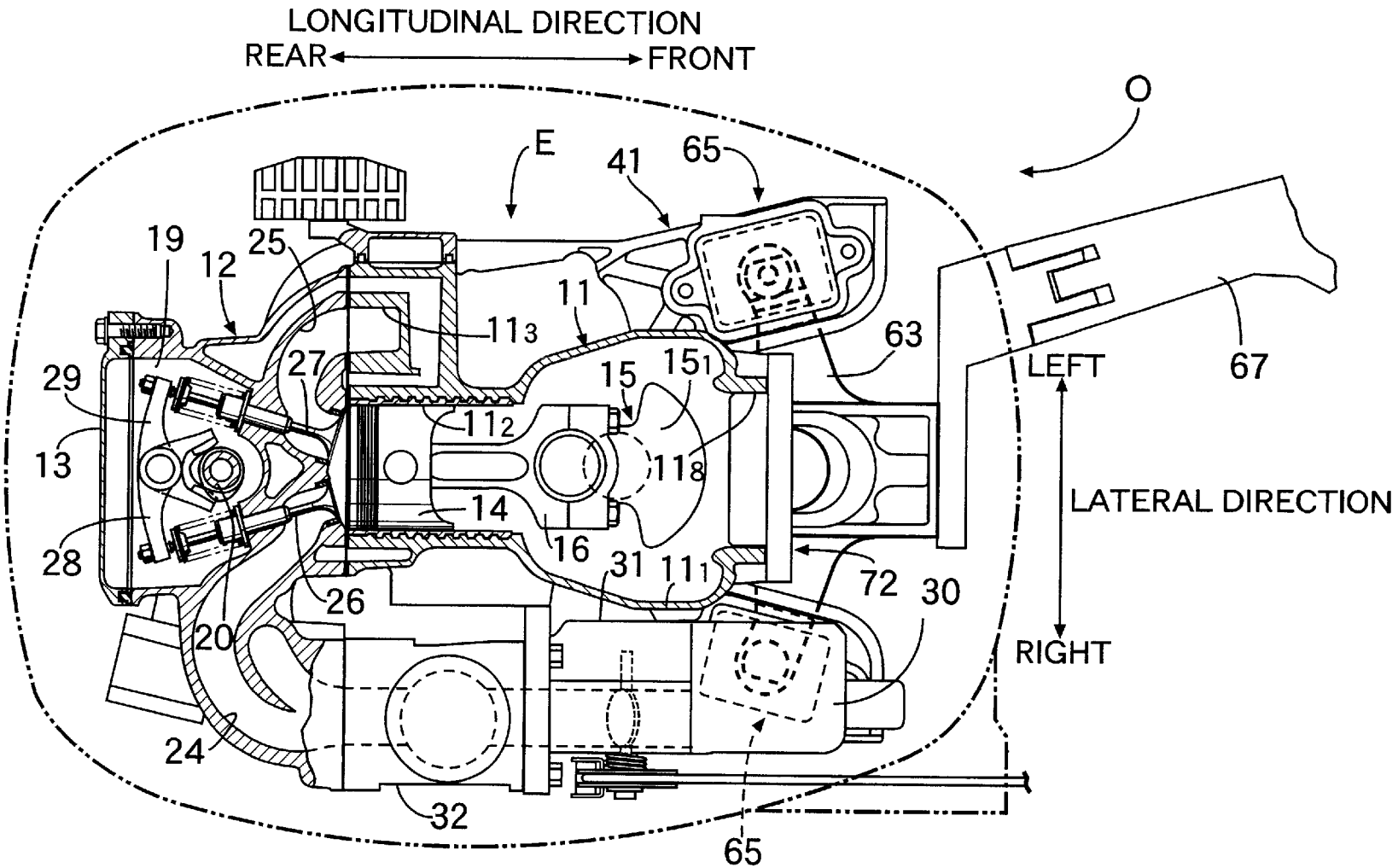

As shown in FIGS. 1 to 3, a two-cylinder and 4-cycle engine E mounted at an upper portion of an outboard engine system O includes an engine block 11 integrally provided with a crankcase $\mathbf{11}_1$ and cylinder bores $\mathbf{11}_2$, $\mathbf{11}_2$ at two upper and lower points, a cylinder head 12 coupled to the engine block 11, and a head cover 13 coupled to the cylinder head 12. Two pistons 14, 14 slidably received in the two cylinder bores $\mathbf{11}_2$, $\mathbf{11}_2$ defined in the engine block 11 are connected to a crankshaft 15 supported on the engine block 11 through connecting rods 16, 16, respectively.

A generator 17 and a recoiled stator 18 are coaxially mounted at an end of the crankshaft 15 protruding upwards from the engine block 11. A camshaft 20 is supported in a valve operating chamber 19 defined between the cylinder head 12 and the head cover 13, and a cam pulley 21 mounted at an upper end of the camshaft 20 and a crank pulley 22 mounted at an upper portion of the crankshaft 15 are connected to each other by a timing belt 23. An intake valve 26 and an exhaust valve 27 for respectively opening and closing an intake port 24 and an exhaust port 25 defined in the cylinder head 12 are connected to the camshaft 20 through an intake rocker arm 28 and an exhaust rocker arm 29, respectively. An air cleaner 30, a throttle valve 31 and a carburetor 32 are disposed on a right side of the engine E and connected to the intake port 24.

An axis of the crankshaft 15 is disposed vertically, and axes of the cylinder bore $\mathbf{11}_2$, $\mathbf{11}_2$ are disposed longitudinally, so that a side adjacent the crankcase $\mathbf{11}_1$ faces forwards, and a side adjacent the cylinder head 12 faces rearwards. The crank phases of the two pistons 14, 14 are the same as each other, and the timings of ignition provided by the pistons 14, 14 are displaced from each other through 360°. Counterweights $\mathbf{15}_1$ are mounted on the crankshaft 15 and have a balance rate of 100% for countering the mass of reciprocal movement of the pistons 14, 14.

An upper surface of an oil case 41 as an oil pan forming member is coupled to a lower surface of the engine E having the above-described structure. An upper surface of an extension case 42 is coupled to a lower surface of the oil case 41, and an upper surface of a gear case 43 is coupled to a lower surface of the extension case 42. An outer periphery of the oil case 41 and an outer periphery of lower half of the engine E are covered with an undercover 44 coupled to an upper end of the extension case 42, and upper half of the engine E is covered with an engine cover 45 coupled to an upper end of the undercover 44.

As can be seen from FIG. 2, the oil case 41 is integrally provided with an oil pan $\mathbf{41}_1$, and a suction pipe 47 including an oil strainer 46 is accommodated within the oil pan $\mathbf{41}_1$. An exhaust passage defining member 48 is coupled to a rear surface of the oil case 41, and an exhaust gas expanding chamber 49 is defined in the extension case 42 with a partition wall $\mathbf{42}_1$ formed therebetween.

An exhaust gas exiting from the exhaust port 25 is passed through a main exhaust passage $\mathbf{11}_3$ defined in the engine block 11 into a first main exhaust passage $e_1$ defined in the oil case 41 (see an arrow a in FIG. 10) and is then passed through a communication bore $e_2$ into an upper exhaust gas expanding chamber $e_3$ defined in an upper portion of the exhaust gas passage defining member 48. A portion of the exhaust gas within the upper exhaust gas expanding chamber $e_3$ is passed through a communication bore $e_4$ into a second main exhaust gas passage $e_5$ defined in the oil case 41 and then via the exhaust gas expanding chamber 49 in the extension case 42, the inside of the gear case 43 and a hollow portion around a propeller shaft 53 which will be described hereinafter, and then discharged into the outside water. On the other hand, a portion of the exhaust gas within the upper exhaust gas expanding chamber $e_3$ in the exhaust gas passage defining member 48 is passed through a communication bore $e_6$ into a lower exhaust gas expanding chamber $e_7$ defined in a lower portion of the exhaust gas passage defining member 48 and is then discharged through an exhaust outlet $e_8$ into the air. A drainage bore $e_9$ is defined in a lower end of the lower exhaust gas expanding chamber $e_7$ for discharging water accumulated in the lower exhaust gas expanding chamber $e_7$ into the main exhaust gas passage $e_5$ in the oil case 41.

Figure 10:
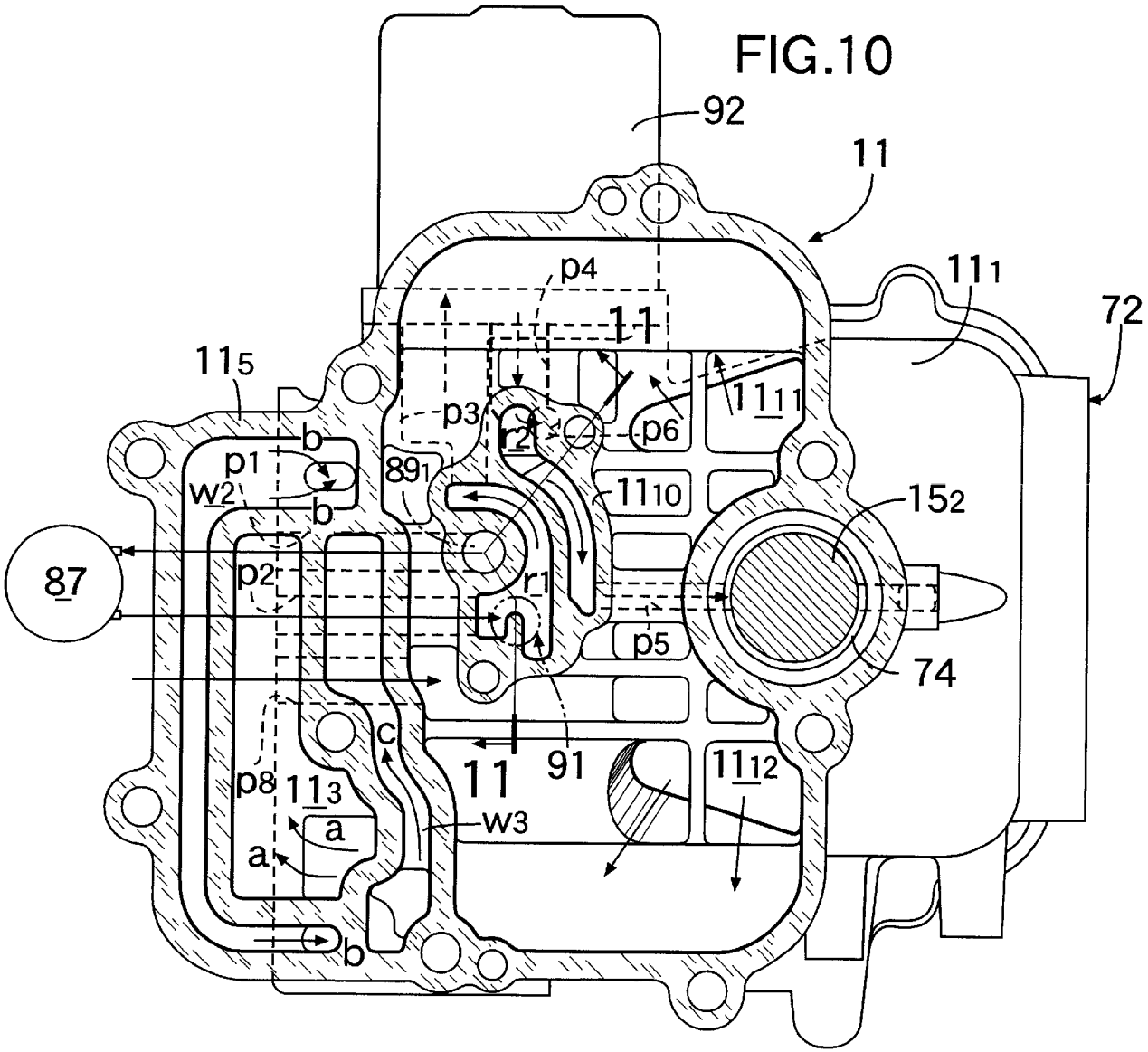
Figure 11:
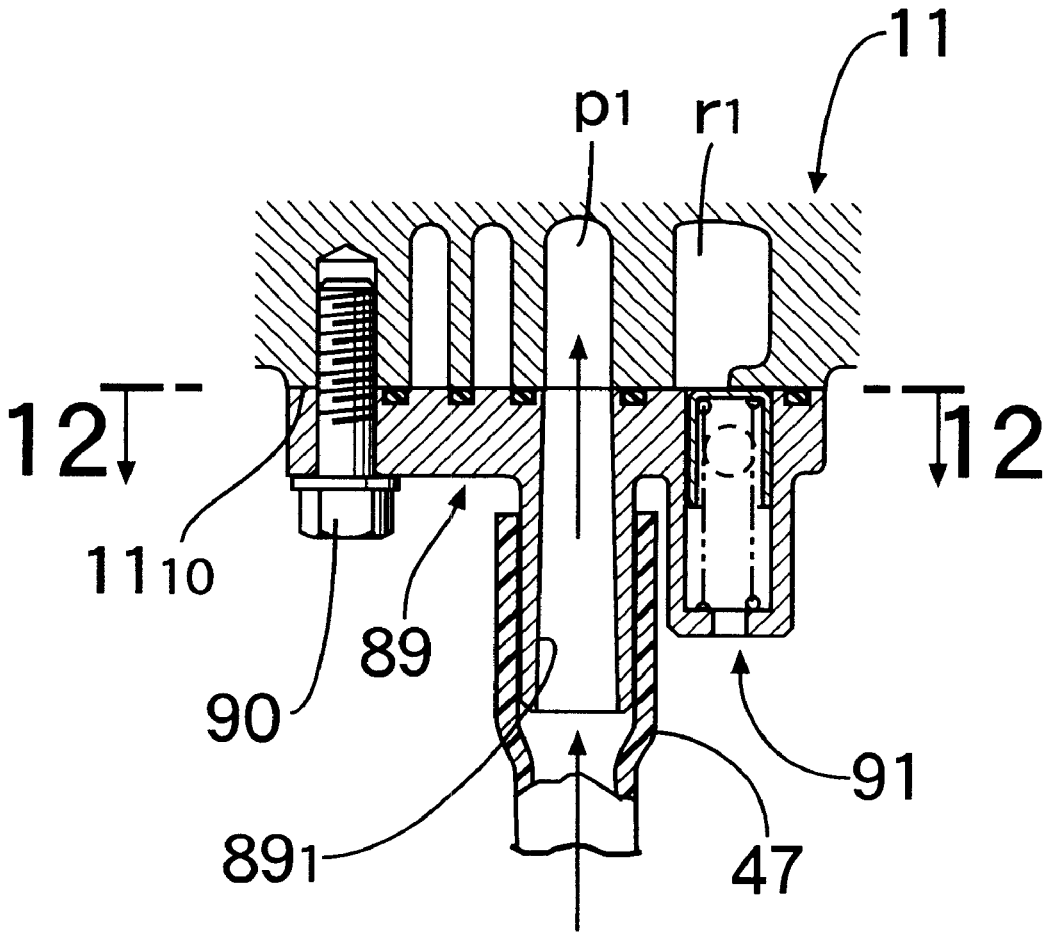
Figure 12:
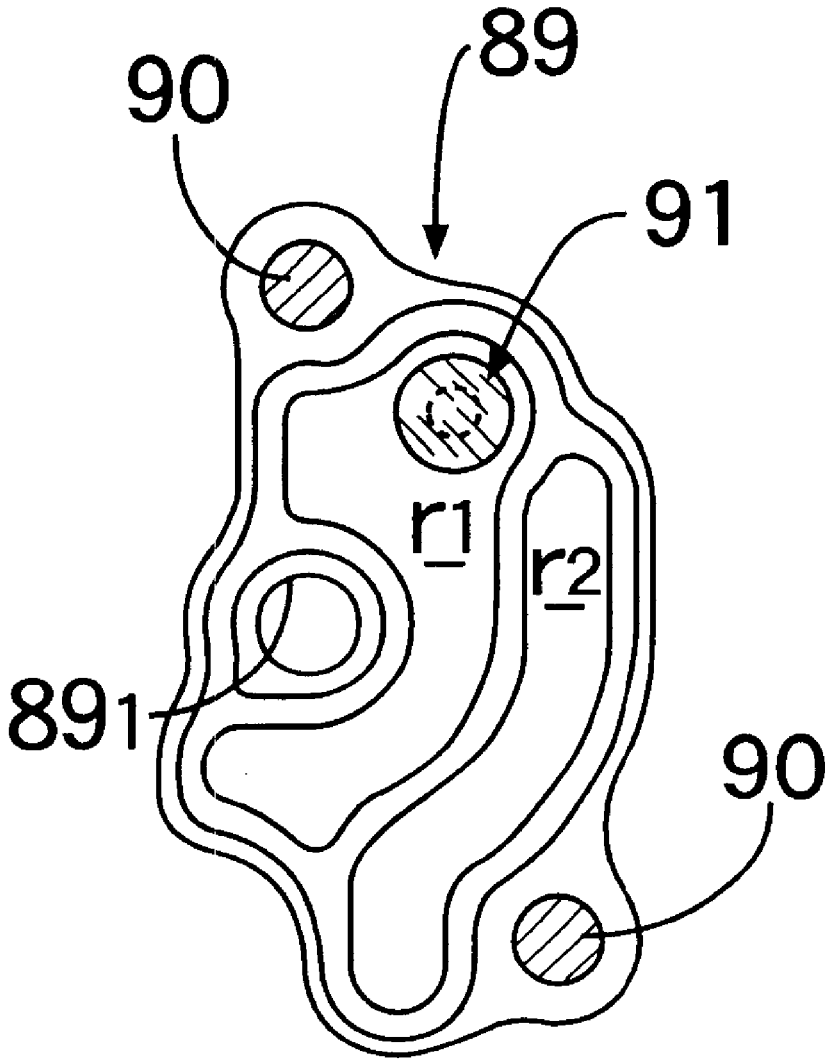

As can be seen from FIGS. 2 and 10, cooling water pumped by a cooling-water pump (not shown) is supplied to cooling-water passages $w_1$ and $w_2$ defined in mating surfaces of the engine block 11 and the oil case 41 and is then diverted into two flows and supplied to the engine block 11 and the cylinder head 12 (see an arrow b in FIG. 10). The cooling water which has cooled each of the engine block 11 and the cylinder head 12 is supplied to a cooling-water passage $w_3$ defined in the lower surface of the engine block 11 (see an arrow c in FIG. 10), and is then passed through a cooling-water passage $w_4$ defined in the oil case 41 and is discharged into the extension case 42.

A driving shaft 50 connected to a lower end of the crankshaft 15 extends through the oil case 41 and downwards within a driving shaft chamber 51 defined in the extension case 42, and is thus connected through a forward/backward movement switchover mechanism 54 to a front end of a propeller shaft 53 which has a propeller 52 at its rear end and is supported longitudinally on the gear case 43.

A mounting bracket 55 for detachably mounting the outboard engine system O to a hull S includes an inversed-J shaped mounting bracket body 56 and a setscrew 57 threadedly fitted in the mounting bracket body 56. A swinging arm 59 is pivotally supported at its front end on the mounting bracket body 56 through a pivot pin 58, and a pipe-shaped swivel case 60 is integrally coupled to a rear end of the swinging arm 59. A large number of pinholes $\mathbf{56}_1$ are provided in the mounting bracket body 56, so that the tilting angle of the outboard engine system O about the pivot pin 58 can be regulated by inserting a pin 61 through a pinhole defined in a locking plate $\mathbf{60}_1$ fixed to the swivel case 60 and through any of the pinholes $\mathbf{56}_1$ in the mounting bracket body 56.

A swivel shaft 62 relatively rotatably fitted in the swivel case 60 includes a mount arm 63 and a mount block 64 at its upper and lower ends, respectively. The upper-side mount arm 63 is resiliently connected to the oil case 41 through a pair of left and right upper mounts 65, 65, and the lower-side mount block 64 is resiliently connected to the extension case 42 through a lower mount 66. A steering handlebar 67 is fixed to a front end of the oil case 41, so that the oil case 41 can be swung laterally about the swivel shaft 62 by grasping and operating the steering handlebar 67 laterally, thereby steering the outboard engine system O.

A structure for supporting of the crankshaft 15 in the engine block 11 will be described below with reference to FIGS. 4 to 7 and 9.

The engine block 11 integrally provided with the crankcase $\mathbf{11}_1$ and having the two cylinder bores $\mathbf{11}_2$, $\mathbf{11}_2$ defined therein is provided on its rear surface with a cylinder head-coupled surface $\mathbf{11}_4$ to which the cylinder head 12 is coupled; on its lower surface with an oil case-coupled surface $\mathbf{11}_5$ to which the oil case 42 is coupled; on its upper surface with an upper cover-coupled surface $\mathbf{11}_6$ to which an upper cover 71 is coupled; and on its front surface with a breather device-coupled surface $\mathbf{11}_7$ to which a breather device 72 is coupled for circulating a blow-by gas within the crankcase $\mathbf{11}_1$ to an intake system. The breather device-coupled surface $\mathbf{11}_7$ is formed on a bottom surface of the crankcase $\mathbf{11}_1$ of the engine block 11, and has an opening $\mathbf{11}_8$ (see FIG. 7) defined centrally therein to communicate with an internal space in the crankcase $\mathbf{11}_1$.

Figure 4:
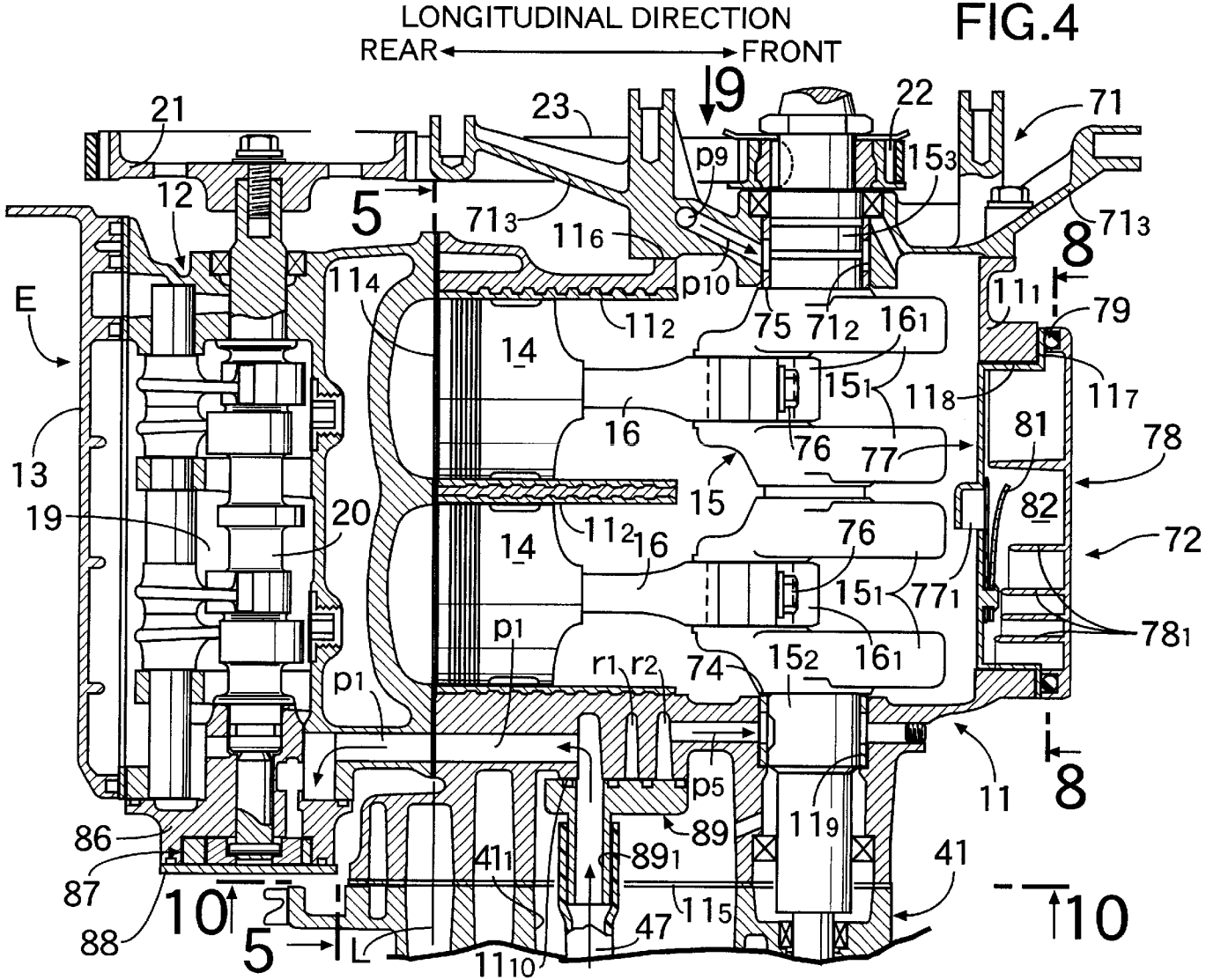
Figure 5:
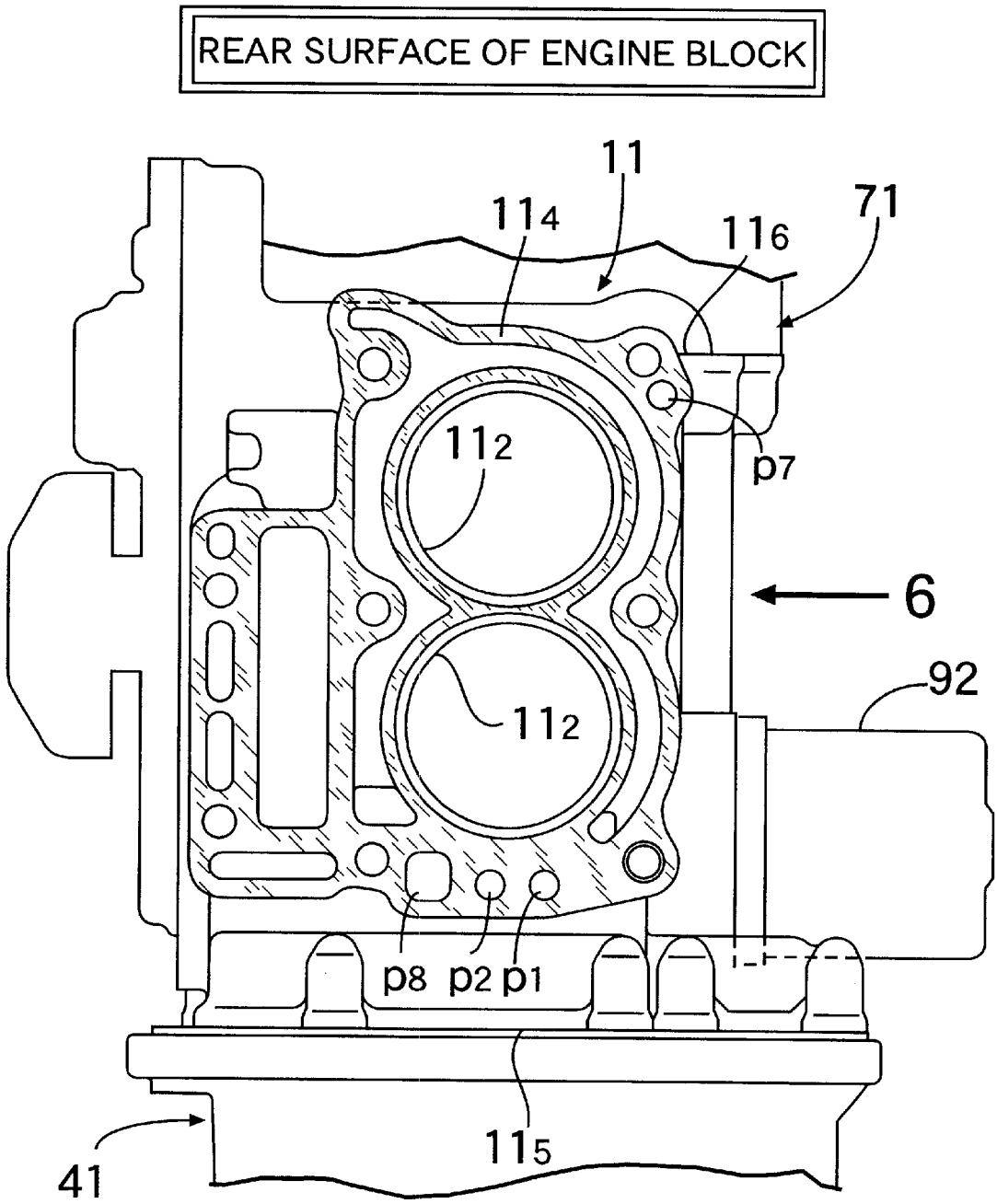
Figure 9:
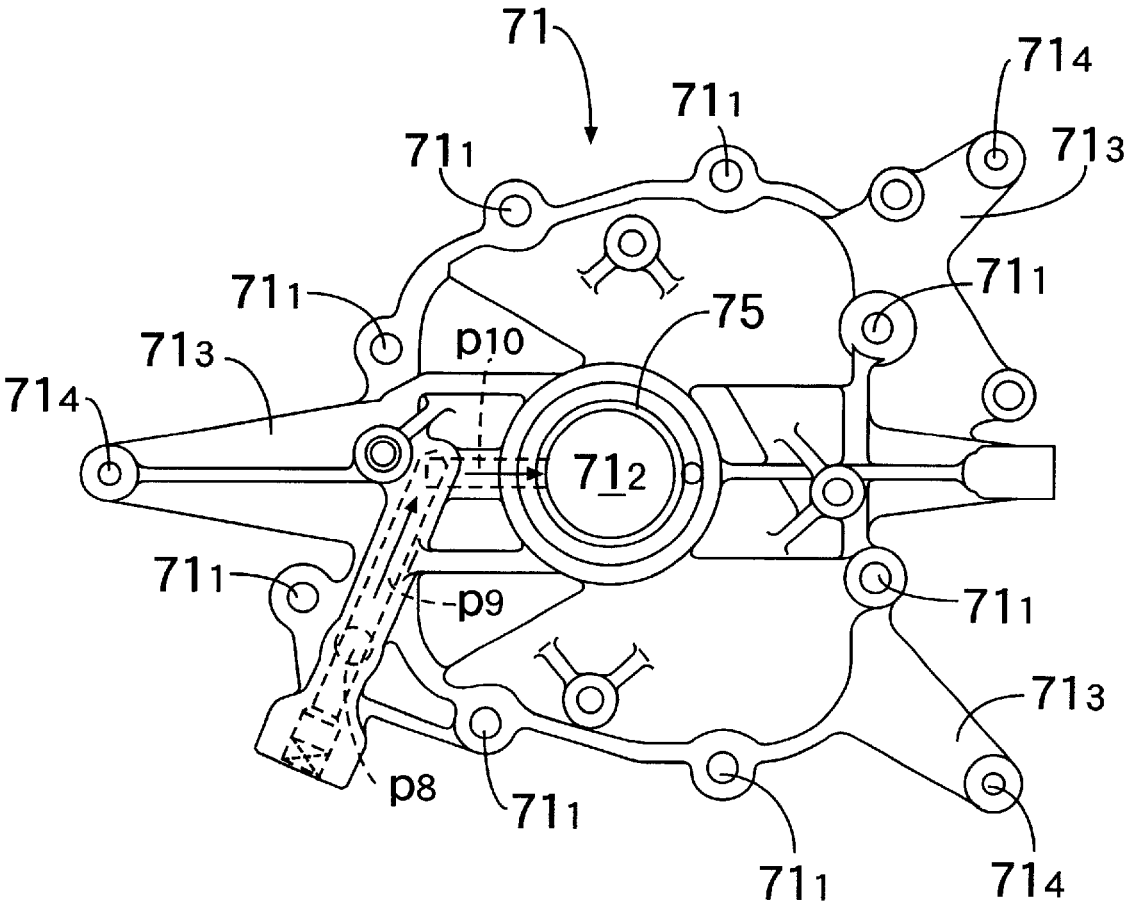

As can be seen from FIGS. 4 and 9, the upper cover 71 is coupled to the upper cover-coupled surface $\mathbf{11}_6$ on the upper surface of the engine block 11 and fastened to the engine block 11 by bolts inserted through eight bolt bores $\mathbf{71}_1$. Three arms $\mathbf{71}_3$ extend radially outwards from a bearing bore $\mathbf{71}_2$ defined at the center of the upper cover 71, so that a stator cover 73 (see FIG. 2) covering the generator 17 and the recoiled stator 18 is fixed by bolt bores $\mathbf{71}_4$ defined in tip ends of the arms $\mathbf{71}_3$.

A lower journal $\mathbf{15}_2$ of the crankshaft 15 disposed to be directed vertically is supported on a bearing metal 74 mounted in a bearing bore $11_9$ in a lower wall of the engine block 11, and an upper journal $15_3$ of the crankshaft 15 is supported on a bearing metal 75 mounted in a bearing bore $71_2$ in the upper cover 71 (see FIG. 4). In a state in which the lower and upper journals $15_2$ and $15_3$ of the crankshaft 15 have been supported on the engine block 11 and the upper cover 71 in the above manner, bearing caps $16_1$, $16_1$ mounted to larger ends of the upper and lower connecting rods 16, 16 by bolts 76 are opposed to the opening $11_8$ defined in the crankcase $11_1$ integral with the engine block 11 (see FIGS. 4 and 7).

Although the two cylinder bores $11_2$, $11_2$ and the bearing bore $11_9$ supporting the lower journal $15_2$ of the crankshaft 15 are defined in the engine block 11 integrally provided with the crankcase $11_1$, they are provided only in the engine block 11 which is a single member, without being astride two members. Thus, in making the cylinder bores $11_2$, $11_2$ and the bearing bore $11_9$, a treatment of machining coupled portions of two members coupled to each other, i.e., a so-called common machining treatment, is not required, thereby making it possible not only to reduce the number of steps required for coupling and separating the two member to and from each other, but also to contribute to an enhancement in machining accuracy. Likewise, the bearing bore $71_2$ supporting the upper journal $15_3$ of the crankshaft 15 is also defined in the upper cover 71 which is a single member and hence, in making the bearing bore $71_2$, a common machining is not required. This contributes to a reduction in number of machining steps and an enhancement in machining accuracy. Moreover, the engine block 11 and the upper cover 71 can be exchanged independently rather than together in a set, leading to an enhanced interchangeability for the components.

The assembling of the components around the crankshaft 15 of the engine E is carried out in the following procedure. In a state in which the lower journal $15_2$ of the crankshaft 15 has been supported in the bearing bore $11_9$ in the engine block 11, the upper cover 71 is coupled to the upper cover-coupled surface $11_6$ of the engine block 11, while fitting the bearing bore $71_2$ in the upper cover 71 over the upper journal $15_3$ of the crankshaft 15. Then, the pistons 14, 14 having the connecting rods 16, 16 previously coupled thereto are fitted into the cylinder bores $11_2$, $11_2$ from the side of the cylinder head-coupled surface $11_4$, whereby the larger ends of the connecting rods 16, 16 of the pistons 14, 14 are brought into engagement with a pin portion of the crankshaft 15, and the bearing caps $16_1$, $16_1$ are fastened by the bolts 76.

Figure 7:
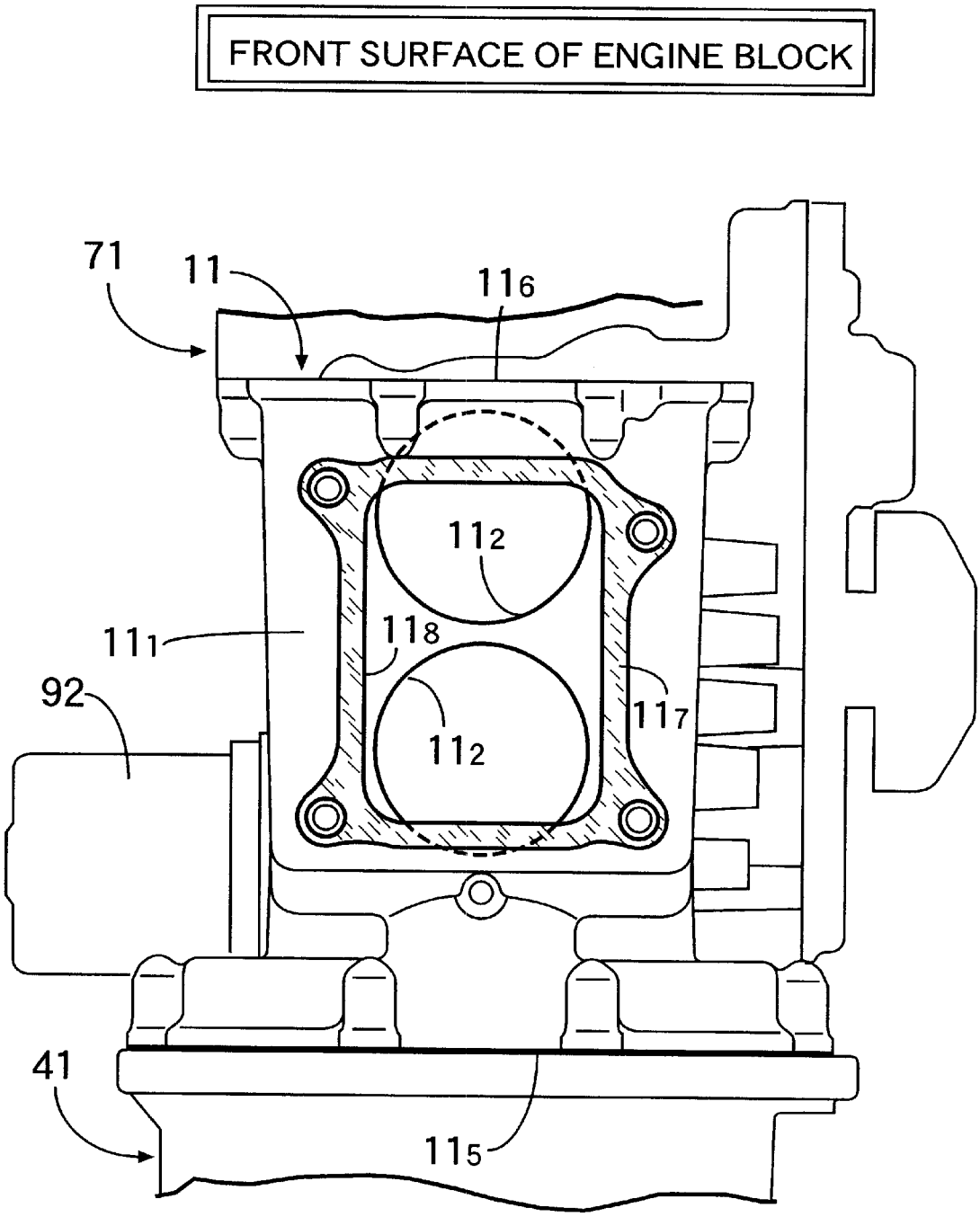

At this time, as can be seen from FIGS. 4 and 7, the larger ends of the connecting rods 16, 16 are opposed to the opening $11_8$ in the front surface of the engine block 11 and hence, an operation of fastening the bearing caps $16_1$, $16_1$ can be carried out easily through the opening $11_8$. Therefore, it is unnecessary to ensure an extra space within the crankcase $11_1$ in order to carry out the operation of fastening the bearing caps $16_1$, $16_1$, and it is possible to assemble the crankshaft 15, while reducing the size of the engine block 11.

Figure 6:
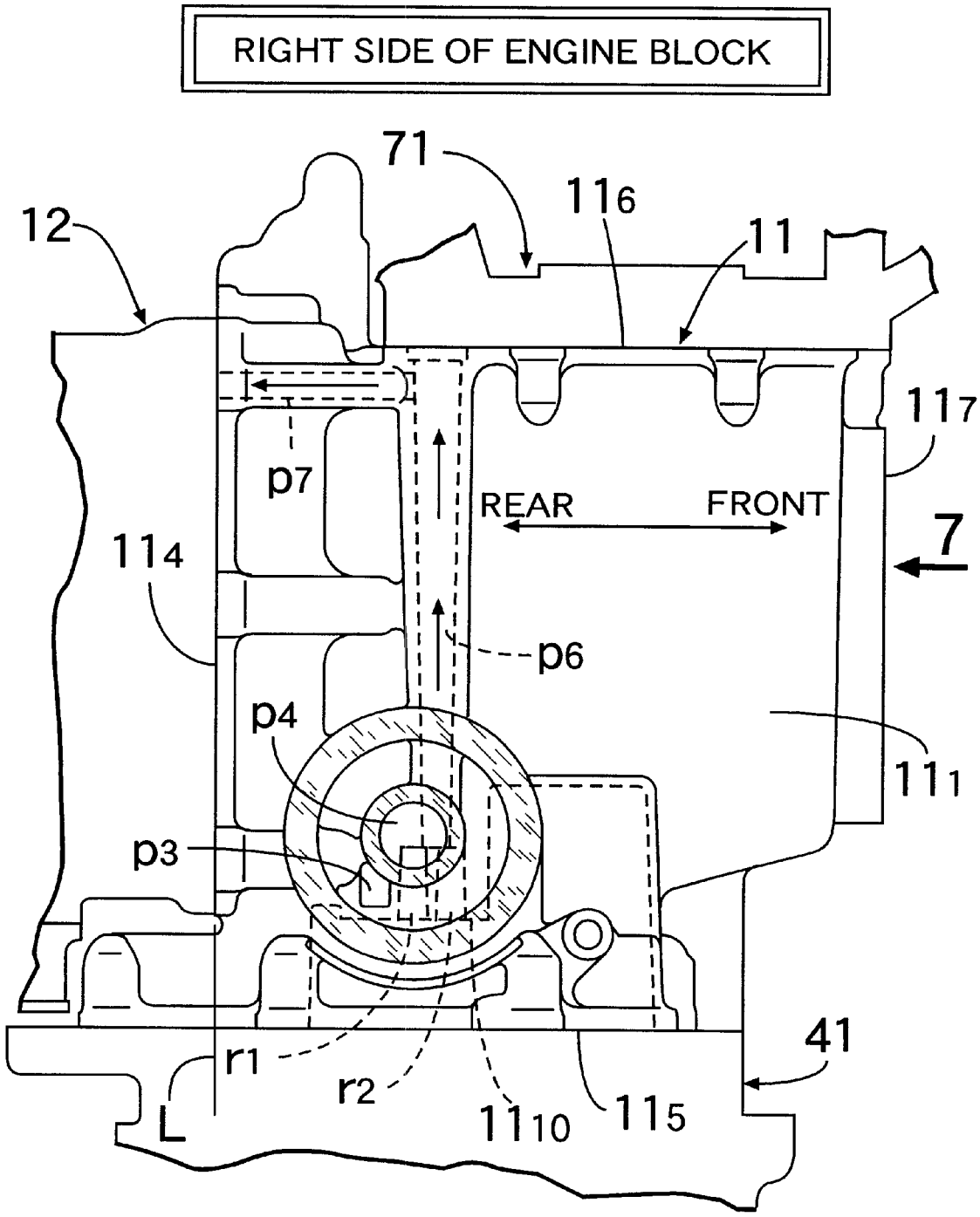

As can be seen from FIGS. 4 and 6, as a result of a rear and lower portion of the engine block 11 protruding rearwards, the horizontal oil case-coupled surface $11_5$ coupling the oil case 41 to the engine block 11 extends rearwards beyond a line L extending downwards from the vertical cylinder head-coupled surface $11_4$ coupling the cylinder head 12 to the engine block 11. Thus, the area of the oil case-coupled surface $11_5$ can be ensured at the maximum and hence, the volume of the oil pan $41_1$ of the oil case 41 coupled to the oil case-coupled surface $11_5$ can be ensured at a sufficient value. Moreover, the oil case-coupled surface $11_5$ and the cylinder head-coupled surface $11_4$ are not continuous to each other and hence, there is no possibility that the sealing of the oil case-coupled surface $11_5$ and the sealing of the cylinder head-coupled surface $11_4$ may be impeded.

In addition, the first and second main exhaust gas passages $e_1$ and $e_5$ and the cooling-water passages $w_1$ and $w_4$ are defined vertically in the vicinity of the oil pan $41_1$ of the oil case 41, but due to the effect of protruding the rear and lower portion of the engine block 11 rearwards, the mating surface of the oil case 41 coupled to the oil case-coupled surface $11_5$ of the engine block 11 is also increased and hence, the first and second main exhaust gas passages $e_1$ and $e_5$ and the cooling-water passages $w_1$ and $w_4$ can be disposed so as not to interfere with the opening in the oil pan $41_1$. As a result, the area of the opening in the oil pan $41_1$ can be increased, leading to an increase in volume.

Figure 8:
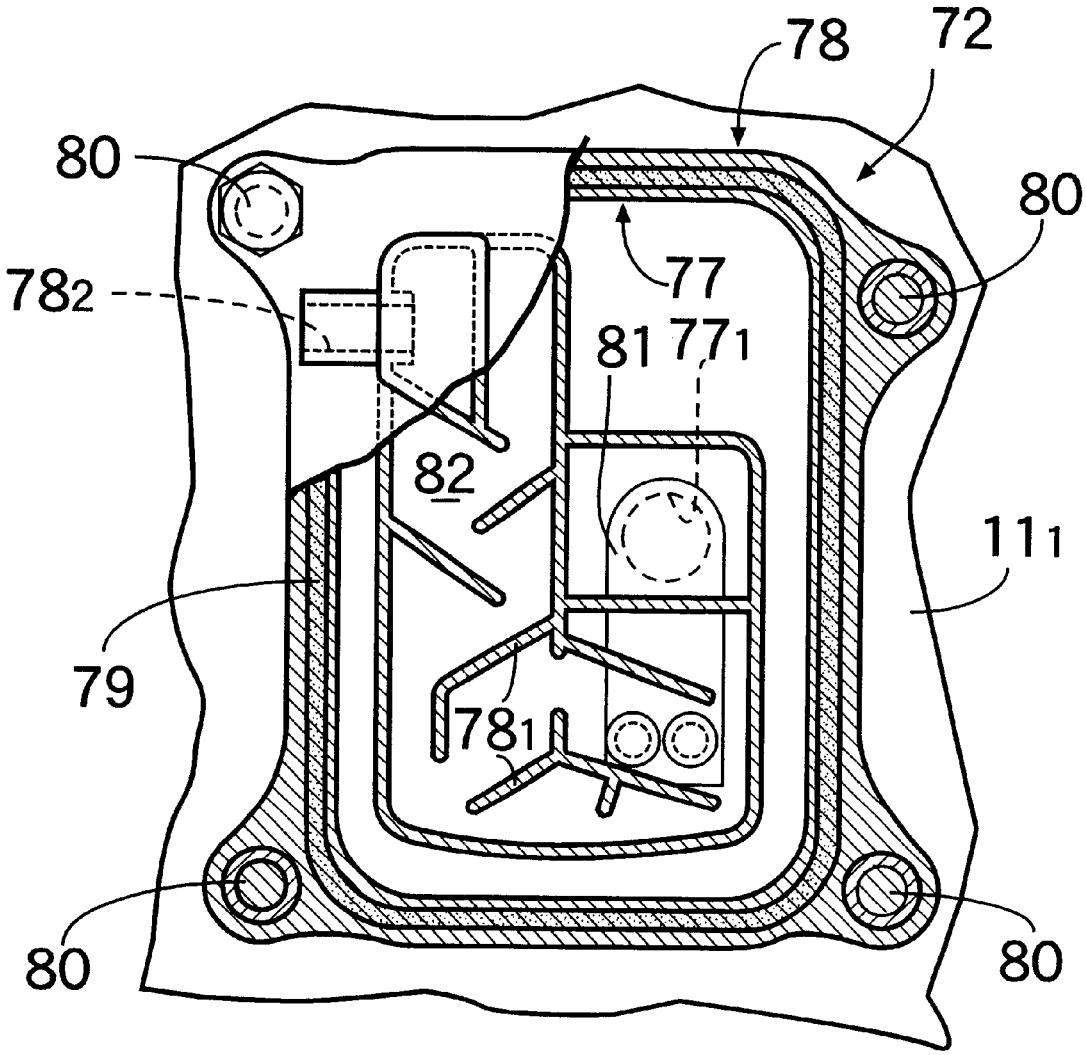

As can be seen from FIGS. 4 and 8, the breather device 72 mounted to close the opening $11_8$ in the engine block 11 is formed into a box shape from an inner member 77 and an outer member 78 coupled to each other with a seal member 79 interposed therebetween. The breather device 72 is mounted to the engine block 11 by four bolts 80. An opening $77_1$ is defined in the inner member 77 to communicate with the crank chamber, and a reed valve 81 is mounted on an inner surface of the inner member 77 for opening and closing the opening $77_1$. A projection wall $78_1$ is formed on an inner surface of the outer member 78 to protrude toward the inner member 77, and a labyrinth 82 is defined by the projection wall $78_1$. A communication bore $78_2$ is defined in an outer surface of the outer member 78 for permitting an internal space in the labyrinth 82 to communicate with the intake system in the engine E through a breather pipe (not shown).

The structure of a lubricating system for the engine E will be described with reference to FIGS. 4 to 6 and 9 to 12.

As can be seen from FIG. 4, a pump housing 86 is fixed to the lower surface of the cylinder head 12, and the lower portion of the camshaft 20 is supported in the pump housing 86. An oil pump 87 driven by the lower end of the camshaft 20 is accommodated between a lower surface of the pump housing 86 and a pump cover 88 fixed to the pump housing 86.

As can be seen from FIGS. 4 and 10 to 12, an oil passage defining member 89 is fixed by bolts 90, 90 to a seat surface $11_{10}$ of the engine block 11, which is a ceiling surface of the oil pan $41_1$ integrally provided in the oil case 41. The oil passage defining member 89 is provided with a coupling $89_1$ to which the suction pipe 47 accommodated in the oil pan $41_1$ is connected, and a relief valve 91 for returning a surplus amount of oil discharged by the oil pump 87 to the oil pan $41_1$.

The oil within the oil pan $41_1$ is drawn into the oil pump 87 via the oil strainer 46, the suction pipe 47, the coupling $89_1$, and an oil passage $p_1$ (see FIGS. 4, 5 and 10) extending horizontally through the engine block 11 and the cylinder head 12. The oil discharged from the oil pump 87 is passed through an oil passage $p_2$ (see FIGS. 5 and 10) defined in parallel to the oil passage $p_1$ and extending horizontally through the engine block 11 and the cylinder head 12, and is supplied to an oil chamber $r_1$ (see FIGS. 10 to 12) defined between the engine block 11 and the oil passage defining member 89 and then via an oil passage $p_3$ (see FIG. 10) defined in the engine block 11 into an oil filter 92 mounted on a right side of the engine block 11. The relief valve 91 faces the oil chamber $r_1$.

The oil resulting from the filtering in the oil filter 92 is supplied via an oil passage $p_4$ (see FIG. 10) defined in the engine block 11 into an oil chamber $r_2$ (see FIGS. 4 and 10) defined between the engine block 11 and the oil passage defining member 89 and then via an oil passage $p_5$ (see FIGS. 4 and 10) defined in the engine block 11 to the bearing metal 74 and the lower journal $\mathbf{15}_2$ of the crankshaft 15. The supplying of the oil to a lower crankpin of the crankshaft 15 is conducted from the lower journal $\mathbf{15}_2$ through an oil passage (not shown) defined in the crankshaft 15.

On the other hand, a portion of the oil supplied to the oil chamber $r_2$ is supplied to an oil passage $p_6$ (see FIGS. 6 and 10) extending vertically in the engine block 11. Then, the oil is supplied via an oil passage $p_7$ (see FIGS. 5 and 9) diverted horizontally from the oil passage $p_6$ at a point close to an upper end of the oil passage $p_6$ and extending through the engine block 11 and the cylinder head 12 into the valve operating chamber 19 to lubricate a valve operating mechanism accommodated in the valve operating chamber 19. The oil, which has lubricated the valve operating mechanism, is returned from a lower end of the valve operating chamber 19 via an oil passage $p_8$ (see FIGS. 5 and 10) extending horizontally through the cylinder head 12 and the engine block 11 to the oil pan $\mathbf{41}_1$.

The oil supplied to the oil passage $p_6$ (see FIG. 6) extending upwards in the engine block 11 is supplied via oil passages $p_9$ and $p_{10}$ (see FIGS. 4 and 9) defined in the upper cover 71 to the bearing metal 75 and the upper journal $\mathbf{15}_3$ of the crankshaft 15. The supplying of the oil to an upper crankpin of the crankshaft 15 is conducted from the upper journal $\mathbf{15}_3$ through an oil passage (not shown) defined in the crankshaft 15.

In this way, the supplying of the oil to the upper journal $\mathbf{15}_3$ of the crankshaft 15 farthest from the oil pump 87 is conducted through the oil passage $p_6$ (see FIG. 6) defined in the engine block 11 and the oil passages $p_9$ and $p_{10}$ defined in the upper cover 71 without through an oil passage defined in the crankshaft 15. Therefore, it is possible not only to supply a sufficient amount of the oil to the upper journal $\mathbf{15}_3$ to achieve the reliable lubrication, but also to substantially simplify the structures of the oil passages.

As can be seen from FIG. 4, the oil passage $p_{10}$ in the upper cover 71 is inclined obliquely and downwards toward the bearing bore $\mathbf{71}_2$ and hence, can be comprised of a blind bore made from the side of the bearing bore $\mathbf{71}_2$ by a drill. Therefore, a blind plug is not required, leading to reductions in number of machining step and in number of parts or components. This is because if the oil passage $p_{10}$ is comprised of a through-bore extending from an outer surface of the upper cover 71 to the bearing bore $\mathbf{71}_2$, it is necessary to close an opened end of the through-bore adjacent the outer surface by a blind plug.

The oil collected from each of portions to be lubricated in the engine E into the crankcase $\mathbf{11}_1$ is returned to the oil pan $\mathbf{41}_1$ via openings $\mathbf{11}_{11}$ and $\mathbf{11}_{12}$ (see FIG. 10) in the oil case-coupled surface $\mathbf{11}_5$ of the engine block 11.

Figure 13:
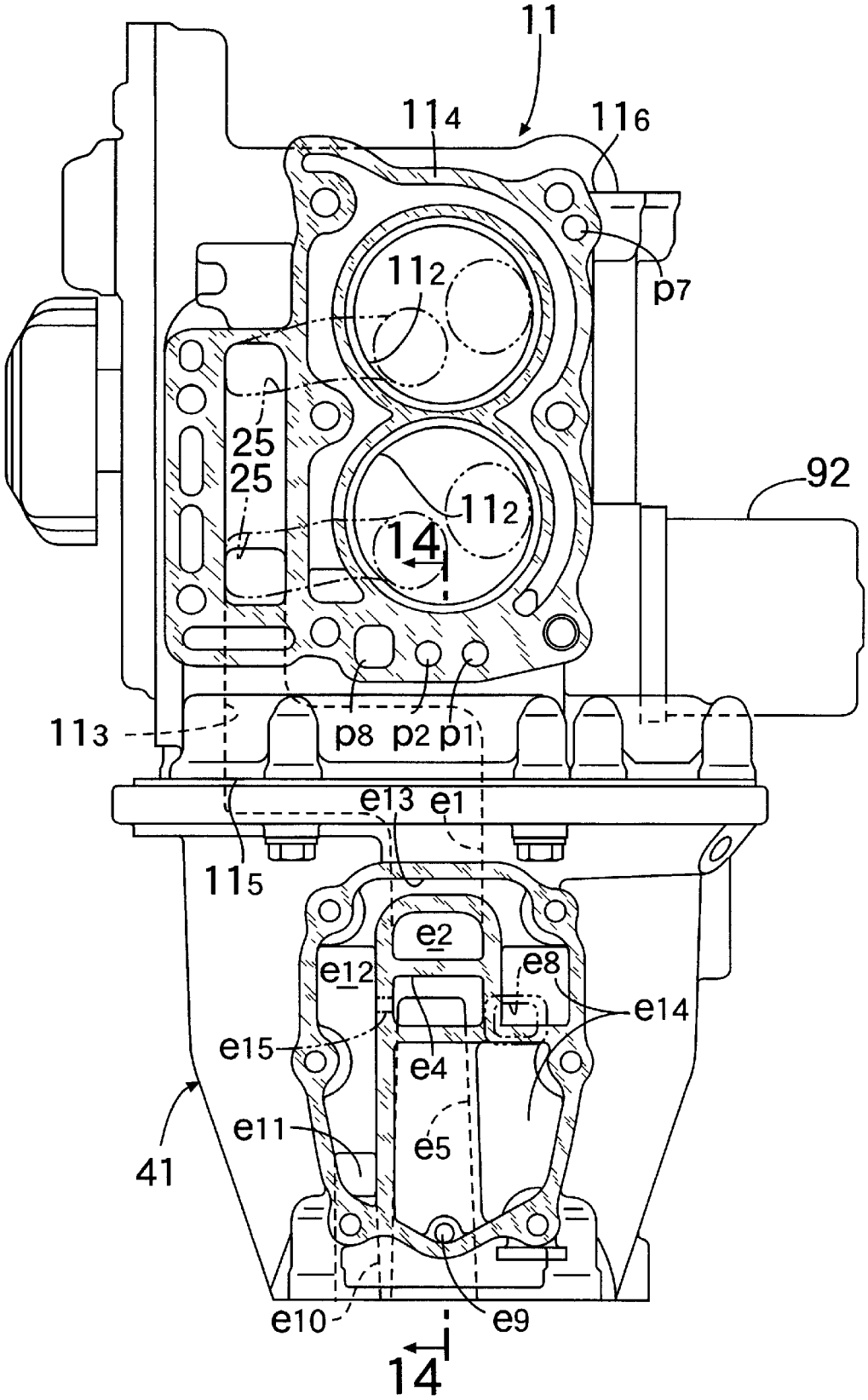
Figure 14:
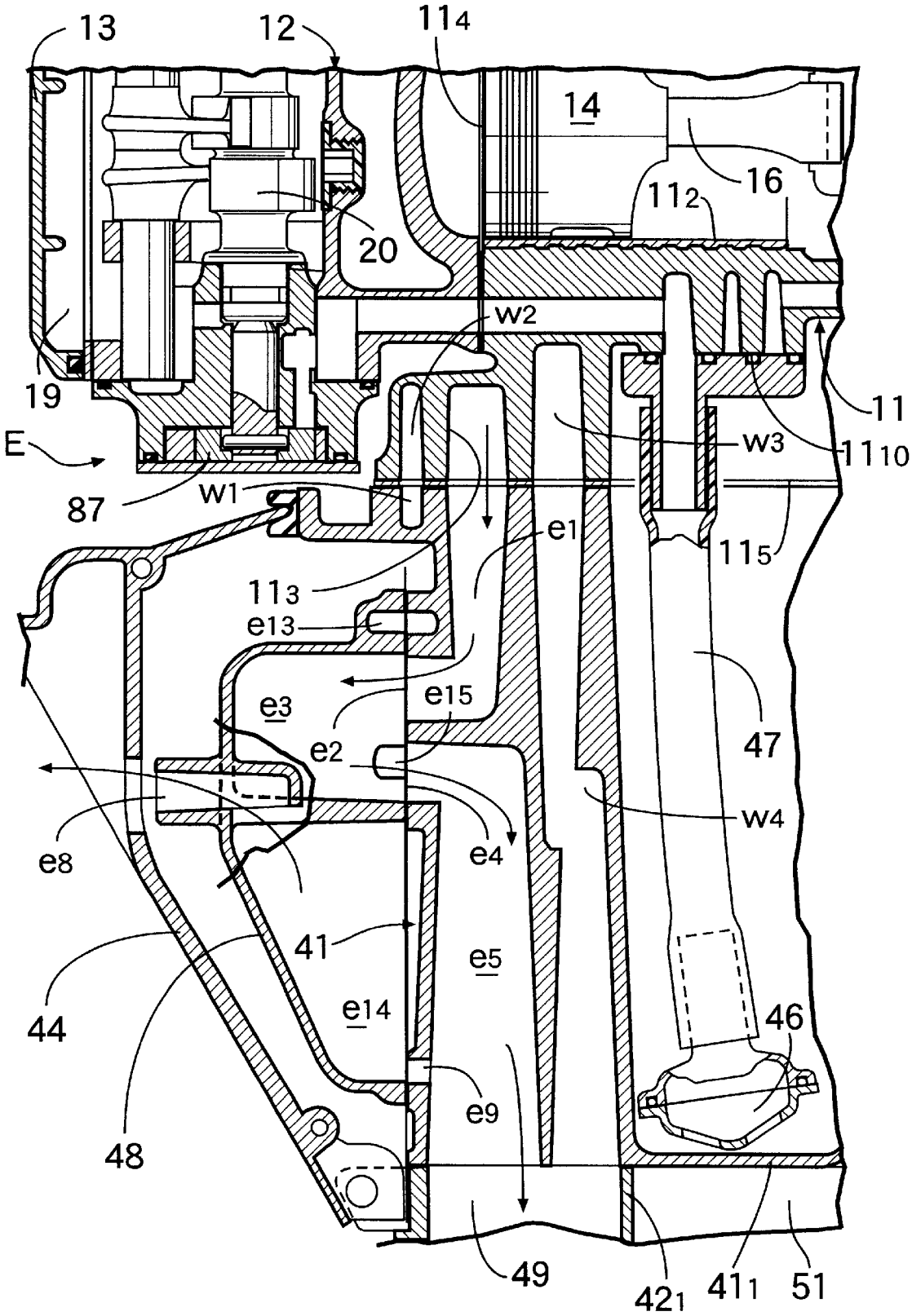

FIGS. 13 and 14 show a second embodiment of the present invention. FIG. 13 is a rear view of an engine block and an oil case, and FIG. 14 is an enlarged sectional view taken along a line 14—14 in FIG. 13.

The second embodiment is different from the first embodiment in respect of the structure of an exhaust system. More specifically, an exhaust gas exiting from the exhaust port 25 is passed through the main exhaust gas passage $\mathbf{11}_3$ defined in the engine block 11 into the first main exhaust passage $e_1$ defined in the oil case 41 (see an arrow a in FIG. 10) and is then passed through the communication bore $e_2$ into the upper exhaust gas expanding chamber $e_3$ defined in the upper portion of the exhaust gas passage defining member 48. The exhaust gas within the upper exhaust gas expanding chamber $e_3$ is passed through the communication bore $e_4$ into the second main exhaust gas passage $e_5$ defined in the oil case 41 and is then discharged into the exhaust gas expanding chamber 49 in the extension case 42.

A subsidiary exhaust gas passage $e_{10}$ is defined in parallel to a left side of the second main exhaust gas passage $e_5$ to extend upwards from the exhaust gas expanding chamber 49 in the extension case 42. The subsidiary exhaust gas passage $e_{10}$ communicates with a first subsidiary exhaust gas expanding chamber $e_{12}$ defined between the oil case 41 and the exhaust gas passage defining member 48 through a communication bore $e_{11}$. The first subsidiary exhaust gas expanding chamber $e_{12}$ communicates with a second subsidiary exhaust gas expanding chamber $e_{14}$ defined between the oil case 41 and the exhaust gas passage defining member 48 through a narrowed passage $e_{13}$ defined between the oil case 41 and the exhaust gas passage defining member 48 and having a throttling effect. The second subsidiary exhaust gas expanding chamber $e_{14}$ communicates with an exhaust outlet $e_8$ provided in the rear surface of the exhaust gas passage defining member 48. A lower end of the second subsidiary exhaust gas expanding chamber $e_{14}$ communicates with the second main exhaust gas passage $e_5$ through the drainage bore $e_9$ and also with the upper exhaust gas expanding chamber $e_3$ and the first subsidiary exhaust gas expanding chamber $e_{12}$ through a negative-pressure relief bore $e_{15}$ defined in the exhaust gas passage defining member 48.

Even according to the second embodiment, the area of the oil case-coupled surface $\mathbf{11}_5$ coupling the oil case 41 to the engine block 11 is increased by the rearward protrusion of the rear and lower portion of the engine block 11 and hence, it is easy to dispose the first and second main exhaust gas passages $e_1$ and $e_5$ and the cooling-water passages $w_1$ and $w_4$ in the oil case-coupled surface $\mathbf{11}_5$ without interference with the opening in the oil pan $\mathbf{41}_1$ and as a result, the area of the opening in the oil pan $\mathbf{41}_1$ can be increased, leading to an increased volume.

Although the embodiments of the present invention have been described in detail, it will be understood that the present invention is not limited to the above-described embodiments, and various modifications in design may be made without departing from the subject matter of the invention.

For example, the vertical engine E of the outboard engine system O has been illustrated in the embodiments, but the present invention is applicable to a vertical engine in any other application.

INDUSTRIAL APPLICABILITY

As discussed above, the present invention is applicable to a vertical engine in which an oil pan is coupled to an oil pan-coupled surface formed on a lower surface of an engine block, and a vertical engine in which an oil is supplied to a bearing bore in a journal of a crankshaft, and preferably applicable particularly to a vertical engine for an outboard engine system.

What is claimed is:

1. A vertical engine comprising an engine block including a cylinder bore integrally provided therein and a crankshaft supported to be directed vertically, a cylinder head coupled to a cylinder head-coupled surface vertically formed on said engine block, and an oil pan coupled to an oil pan-coupled surface horizontally formed on said engine block, wherein said oil pan-coupled surface extends below said cylinder head beyond a line extending downwards from said cylinder head-coupled surface.

2. A vertical engine according to claim 1, wherein an oil pan forming member having said oil pan integrally provided therein is integrally formed with a peripheral wall of a main exhaust passage.

3. A vertical engine according to claim 1 or 2, wherein said oil pan forming member is integrally formed with a peripheral wall of a cooling-water passage.

4. A vertical engine having a crankshaft supported to be directed vertically, comprising an engine block which is formed by molding integrally with a cylinder bore and a crankcase and which has a bearing bore defined therein for supporting a lower journal of said crankshaft, an upper cover which is coupled to said engine block to close an opening in an upper surface of said engine block and which has a bearing bore defined therein for supporting an upper journal of said crankshaft, an oil pan coupled to a lower surface of said engine block, an oil pump for supplying an oil within said oil pan to portions to be lubricated, and an oil passage which is defined to extend in said engine block and said upper cover while bypassing the crankshaft and through which the oil discharged from said oil pump is supplied to the bearing bore for supporting the upper journal of said crankshaft.

5. A vertical engine having a crankshaft supported to be directed vertically, comprising:

an engine block which is formed by molding integrally with a cylinder bore and a crankcase and which has a bearing bore defined therein for supporting a lower journal of said crankshaft, an upper cover which is coupled to said engine block to close an opening in an upper surface of said engine block and which has a bearing bore defined therein for supporting an upper journal of said crankshaft, an oil pan coupled to a lower surface of said engine block, an oil pump for supplying an oil within said oil pan to portions to be lubricated, and an oil passage which is defined in said engine block and said upper cover and through which the oil discharged from said oil pump is supplied to the bearing bore for supporting the upper journal of said crankshaft, wherein a most downstream portion of said oil passage defined in said upper cover comprises a blind bore provided at a location spaced obliquely and upwards apart from an inner peripheral surface of said bearing bore in said upper cover.

* * * * *